US007922546B1

(12) United States Patent
Smith et al.

(10) Patent No.: US 7,922,546 B1
(45) Date of Patent: Apr. 12, 2011

(54) GROUNDING CLAMP

(75) Inventors: William Smith, Kirkland (CA); Daniel Cardin, Sainte-Julie (CA)

(73) Assignee: Thomas & Betts Intenational, Inc., Wilmington, DE (US)

( * ) Notice: Subject to any disclaimer, the term of this patent is extended or adjusted under 35 U.S.C. 154(b) by 0 days.

(21) Appl. No.: 12/629,181

(22) Filed: Dec. 2, 2009

(51) Int. Cl.
*H01R 11/03* (2006.01)

(52) U.S. Cl. ..... 439/793; 439/792

(58) Field of Classification Search ..... 439/793, 439/792, 798, 797, 727, 771, 801–815, 765
See application file for complete search history.

(56) References Cited

U.S. PATENT DOCUMENTS

| | | | | | |
|---|---|---|---|---|---|
| 1,345,012 | A | | 6/1920 | Jones | |
| 1,795,627 | A | | 3/1931 | Weritz et al. | |
| 1,864,688 | A | * | 6/1932 | Frank | 439/100 |
| 2,151,524 | A | | 3/1939 | Pittman et al. | |
| 2,157,846 | A | | 5/1939 | Berndt | |
| 3,551,876 | A | * | 12/1970 | Walter | 439/110 |
| 3,727,171 | A | * | 4/1973 | Coles et al. | 439/110 |
| 3,876,279 | A | * | 4/1975 | Underwood | 439/797 |
| 3,924,920 | A | | 12/1975 | Moscioni et al. | |
| 4,080,034 | A | * | 3/1978 | Werner | 439/413 |
| 4,105,272 | A | | 8/1978 | West et al. | |
| 4,114,977 | A | | 9/1978 | Polidori | |
| 4,189,198 | A | | 2/1980 | Reichman | |
| 4,355,852 | A | | 10/1982 | Bachle | |
| 4,457,577 | A | * | 7/1984 | Browne et al. | 439/98 |
| 4,603,376 | A | * | 7/1986 | Maier | 361/824 |
| 4,784,621 | A | * | 11/1988 | Auclair | 439/793 |
| 4,863,390 | A | * | 9/1989 | Cera et al. | 439/100 |
| 4,911,572 | A | * | 3/1990 | Williams | 403/209 |
| 5,015,205 | A | | 5/1991 | Franks, Jr. | |
| 5,152,701 | A | | 10/1992 | Polidori | |
| 5,286,211 | A | | 2/1994 | McIntosh | |
| 5,320,565 | A | | 6/1994 | Polidori | |
| 5,533,913 | A | * | 7/1996 | Boehm et al. | 439/810 |
| 5,632,633 | A | | 5/1997 | Roosdorp et al. | |
| 5,934,818 | A | * | 8/1999 | Schmitt et al. | 403/399 |
| 5,944,566 | A | * | 8/1999 | Gossmann | 439/792 |
| 6,186,839 | B1 | * | 2/2001 | Storey et al. | 439/812 |
| 6,213,818 | B1 | * | 4/2001 | Chadbourne | 439/810 |
| 6,939,183 | B2 | * | 9/2005 | Ferretti et al. | 439/798 |
| 6,986,673 | B2 | * | 1/2006 | de la Borbolla | 439/100 |
| 7,044,776 | B2 | * | 5/2006 | King et al. | 439/521 |
| 7,048,591 | B1 | * | 5/2006 | Chiang | 439/709 |
| 7,160,142 | B2 | | 1/2007 | Hughes et al. | |
| D538,143 | S | * | 3/2007 | Pu et al. | D8/394 |
| 7,441,730 | B2 | * | 10/2008 | Heath | 248/62 |
| 7,537,494 | B1 | * | 5/2009 | Umlauf | 439/798 |

* cited by examiner

*Primary Examiner* — Neil Abrams
*Assistant Examiner* — Harshad C Patel
(74) *Attorney, Agent, or Firm* — Snyder, Clark, Lesch and Chung, LLP

(57) ABSTRACT

A grounding clamp for securing a grounding cable to a tray having a number of spaced apart longitudinal and transverse members includes a body portion having a bottom portion and inner and outer end portions projecting from the bottom portion. The inner end portion includes at least two finger-like members projecting from the bottom portion for engaging at least one transverse member between the finger-like members. A portion of the body portion includes a cavity defined by the bottom portion, the inner end portion, and the outer end portion for receiving at least one longitudinal member therein. The cavity further receives the grounding cable. The outer end portion includes a threaded opening therethrough. The grounding claim further includes a threaded bolt that is received in the threaded opening in the outer end portion for securing the grounding cable to the at least one longitudinal member.

21 Claims, 6 Drawing Sheets

GROUNDING CLAMP

BACKGROUND OF THE INVENTION

The present invention relates to the support and retention of grounding conductors such as cable on cable trays. In particular, the present invention is directed to clamping a grounding conductor with the wire of a steel cable tray.

The organization and management of cabling in various industries has become increasingly important. In order to help protect signal transmission through and the integrity of cable supported by steel cable trays, the cable trays and supported cable must be properly connected with an electrical ground, such as by way of a grounding cable as the grounding conductor.

DETAILED DESCRIPTION OF PREFERRED EMBODIMENTS

The following detailed description refers to the accompanying drawings. The same reference numbers in different drawings may identify the same or similar elements.

Cable trays may be manufactured as wire trays from steel or other conductive material to organize and manage electrical cables. Consistent with implementations described herein, an improved grounding clamp for use with such cable trays may be provided. The cable tray systems disclosed herein support various types of cables and conduits such as electrical cables, communications cables, various types of fluid conduits, pipes and the like. Notwithstanding such uses, the device of the present invention may be referred to as a grounding clamp for grounding a "cable" tray. This term is used for simplicity only, even though conduits other than cables may also be supported by such systems. Accordingly, as the term is used herein for simplicity, the term "cable" will also denote all types of cables and conduits that may be supported in a cable tray in a manner set forth and described below. Similarly, the present description generally refers to a grounding "clamp." For the purposes of this disclosure, the term "clamp" may be used to refer to any device capable of securing one article (e.g., a grounding cable) to another article (e.g., a longitudinal and/or transverse member of a cable tray).

Further, although the following description and figures refer to a cable tray having a particular construction (e.g., a wire mesh type cable tray), other construction types may also be used with the present invention. Also, cable trays described herein may be formed of a wide variety of materials well known in the cable tray art. Common materials useful in forming cable trays are, for example, aluminum, steel, and stainless steel.

Figure 1:
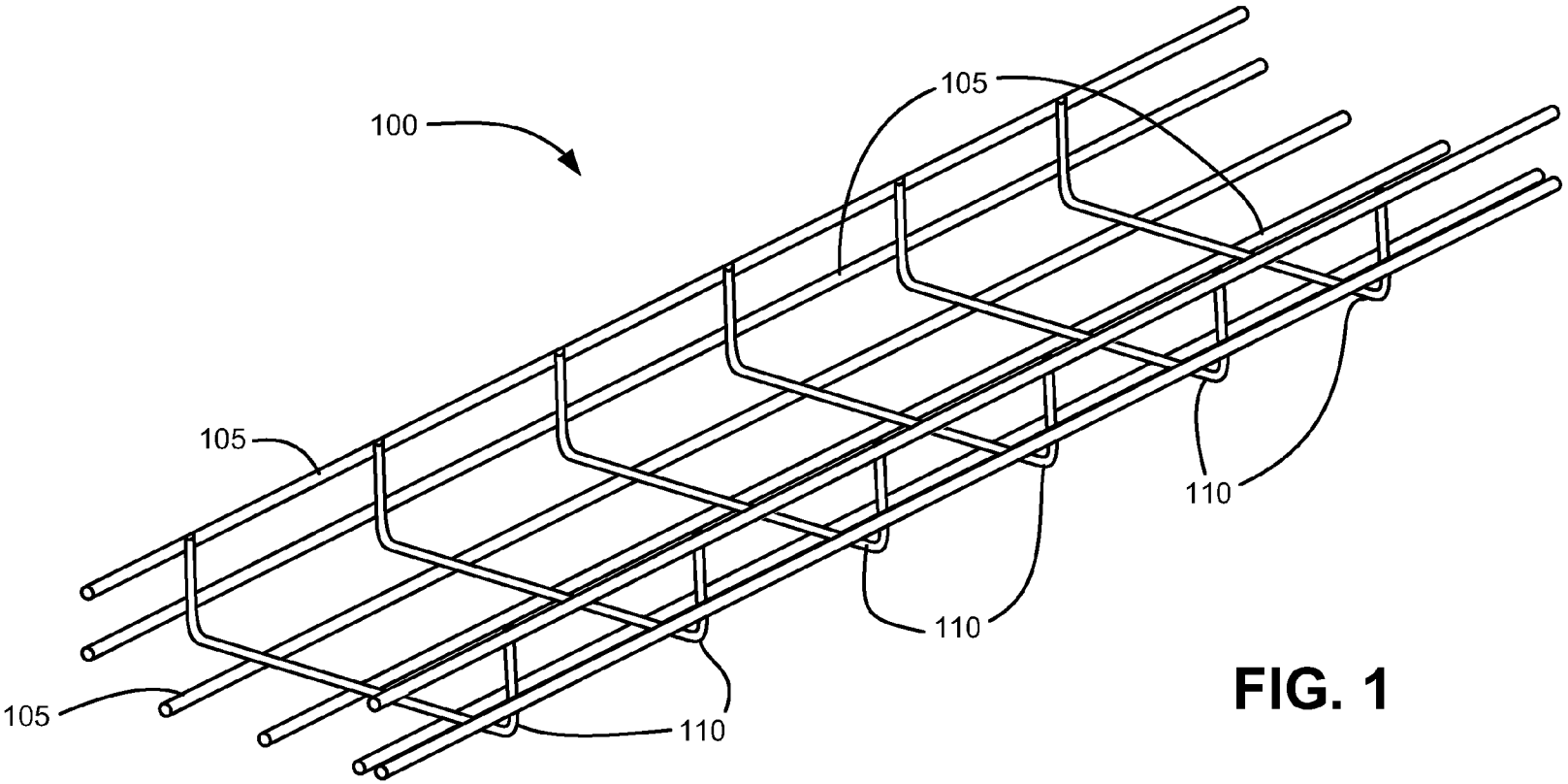
FIG. 1 is an isometric view of a wire cable tray having spaced apart longitudinal and transverse members.

FIG. 1 is an isometric illustration of a cable tray of a cable tray 100 used for organizing and retaining electrical cable. As previously mentioned, it may be important to help protect the integrity of the cable supported by cable tray 100 and to help preserve signal transmission through the cable by properly supplying an electrical ground to cable tray 100. In the provision of an electrical ground, it may be important to make grounding cable easily visible and accessible for inspection. It may also be desirable to avoid placement of grounding cable within the usable cable tray volume.

As illustrated in FIG. 1, cable tray 100 may include be formed as a mesh basket that includes a number of spaced apart longitudinal members 105 and a number of spaced apart transverse members 110 formed substantially perpendicularly to longitudinal members 105. In one implementation, opposing ends of each transverse member 110 may be bent or turned substantially perpendicularly to a remaining portion of each transverse member 110. The intersection of longitudinal members 105 and transverse members 110 forms a substantially mesh-like configuration. This configuration forms a tray capable of supporting elongated materials thereon without risk of rolling or otherwise fall off. Moreover, the mesh-like configuration of cable tray 100 enables cable installers to fasten cables to longitudinal members or transverse members, such as with wire ties or the like. In one embodiment, cable tray 100 may be formed of steel, although other materials may be used.

Figure 2B:
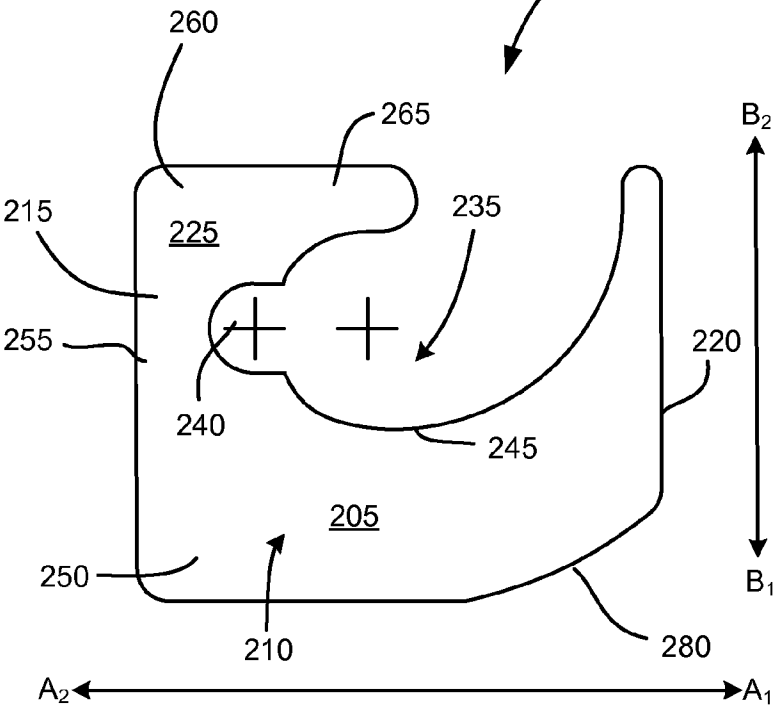
FIGS. 2A-2F are isometric, side, first end, second end, bottom, and top views, respectively, of a grounding clamp consistent with implementations described herein.
Figure 2A:
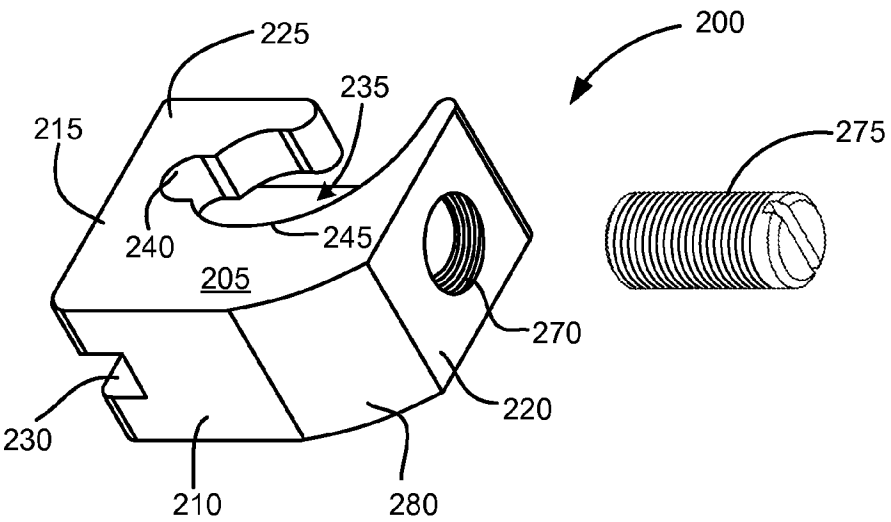
Figure 3:
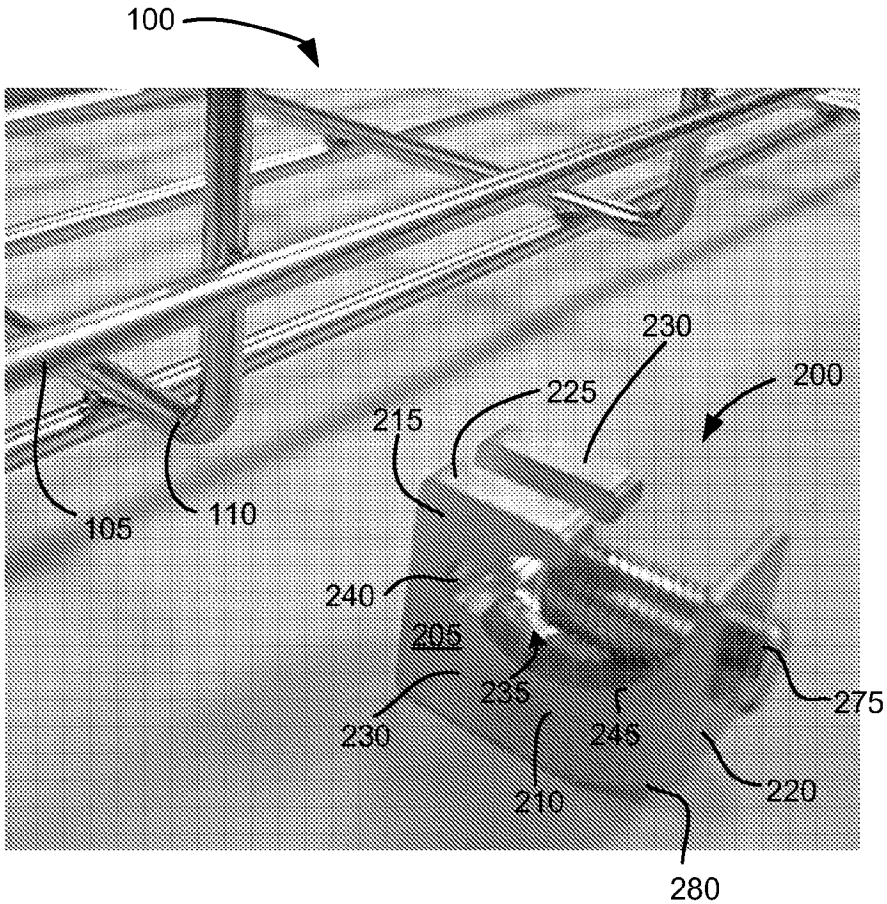
FIG. 3 is an isometric view of the grounding clamp of FIGS. 2A-2F unattached from the cable tray of FIG. 1.
Figure 4:
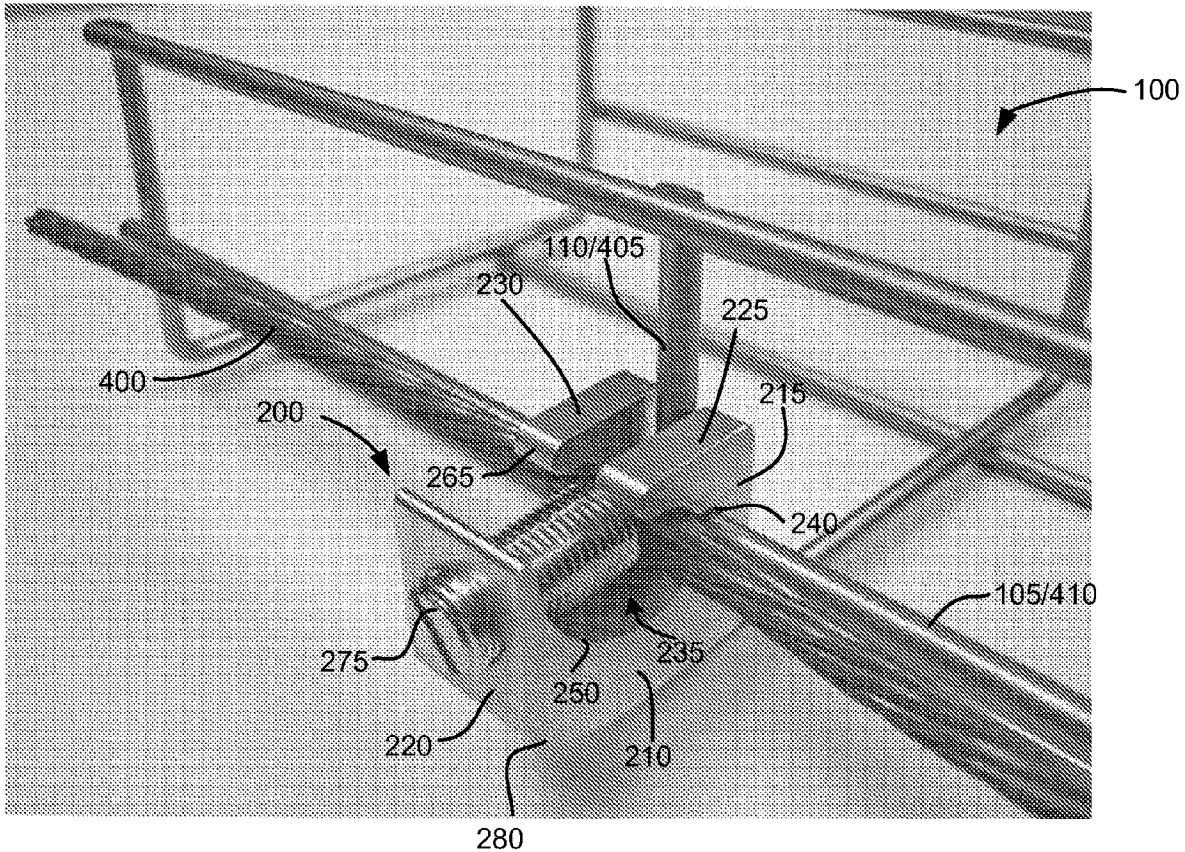
FIG. 4 is an isometric view of the grounding clamp of FIGS. 2A-2F shown attached to the cable tray of FIG. 1.

Consistent with embodiments described herein, a grounding clamp may be used to secure or affix a grounding cable to cable tray 100. FIGS. 2A-2F include an isometric view, a side view, a first end view (taken along the line $A_1$-$A_2$ in FIG. 2B), a second end view (taken along the line $A_2$-$A_1$ in FIG. 2B), a bottom view (taken along the line $B_1$-$B_2$ in FIG. 2B), and a top view (taken along the line $B_2$-$B_1$ in FIG. 2B) of a grounding clamp 200 consistent with implementations described herein. FIG. 3 is an isometric illustration depicting grounding clamp 200 unattached to cable tray 100, while FIG. 4 is an isometric illustration depicting grounding clamp 200 attached to cable tray 100 in the manner described herein. Grounding clamp 200 may facilitate securing of a grounding cable (400 in FIG. 4) to a longitudinal member 105 and a transverse member 110 of cable tray 100. Securing grounding cable 400 to cable tray 100 allows cable tray 100 and any cables or other materials supported or retained thereon to be electrically grounded via grounding cable 400.

In one implementation consistent with aspects described herein, grounding clamp 200 may include a body portion 205 having a bottom portion 210, an inner end portion 215, and an outer end portion 220. As shown in FIGS. 2A and 2B, inner end portion 215 and outer end portion 220 may project, substantially perpendicularly, from bottom portion 210.

In one embodiment, body portion 205 may be formed as in a one-piece configuration and may be formed of a conductive material, such as aluminum, steel, or other suitable material. In an exemplary implementation, body portion 205 may include a thickness of approximately 0.40 to 0.75 inches. Moreover, bottom portion 210 may have a length ranging from 1.0 inches to 1.5 inches. Inner end portion 215 and outer end portion 215 may have heights ranging from 0.9 inches to 1.1 inches. In some implementations, body portion 205 may be of such a mass so as to be sufficient to prevent damage to grounding clamp 200 in the event of a ground fault.

Figure 2D:
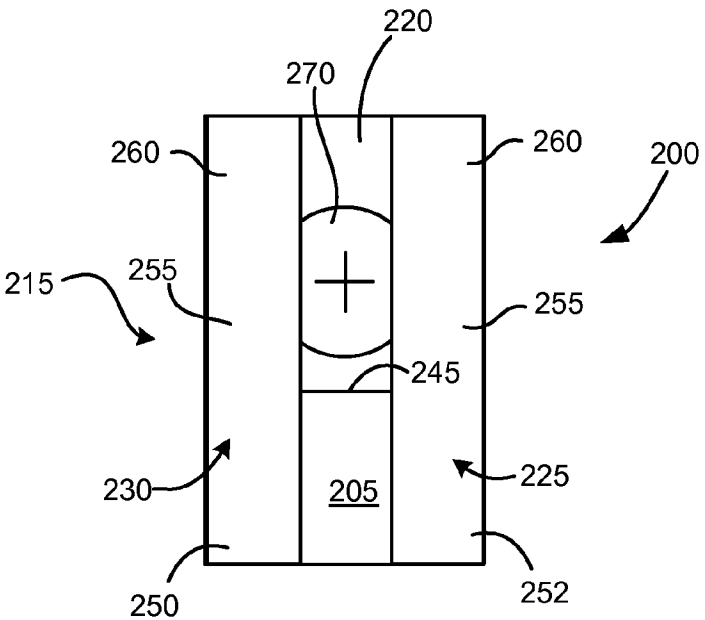

As depicted in FIGS. 2A and 2D, inner end portion 215 may include at least two finger-like members 225 and 230 that project from the bottom portion 210. Finger-like members 225, 230 are best viewed together in FIGS. 3 and 4, but may be easily understood from the views illustrated in FIGS. 2A-2F. Consistent with implementations described herein, finger-like members 225 and 230 may engage at least one transverse member 110 of cable tray 100 following installation. In order to properly engage a transverse member 110, finger-like members 225 and 230 may be spaced apart by a distance substantially similar to the size of transverse members 110. For example, a width of the space between finger-like members 225 and 230 may be substantially similar to a diameter of transverse members 110. In one implementation, finger-like members 225, 230 may be spaced apart by between approximately 0.19 inches and 0.21 inches.

As illustrated in FIG. 4, a selected transverse member 405 of cable tray 100 may be engaged by finger-like members 225, 230, to assist in securing grounding clamp 200 and grounding cable 400 in place. In this orientation, body portion 205 of grounding clamp 200 may extend outwardly away from cable tray 100, thereby ensuring that grounding clamp 200 does not unnecessarily engage the contents of cable tray 100. Further description of the structure and functionality of holding the grounding clamp and grounding cable in place are provided below consistent with the aspects described herein.

As illustrated in FIGS. 2A and 2B, body portion 205 may include a cavity 235 therein defined by an upper surface of bottom portion 210 and inside surfaces of inner end portion 215 and an outer end portion 220, respectively. As illustrated in FIG. 4, cavity 235 may receive a selected longitudinal member 415 of cable tray 100. As shown in FIG. 4, upon engagement of finger-like members 225, 230 about transverse member 405, e.g., by placing the open ends of finger-like members 225, 230 on opposing sides of transverse member 405, transverse member 405 may be received into cavity 235.

Cavity 235 may be further configured to receive the selected longitudinal member 410. As shown in FIGS. 2A and 2B, cavity 235 may include a notch 240 therein for receiving a longitudinal member 105. In one implementation, notch 240 may be formed in an outside edge of finger-like members 225, 230. Furthermore, notched end 240 may include a height substantially similar to a diameter of longitudinal members 105. For example, a height of notch 240 may range from approximately 0.19 inches to 0.21 inches.

As shown in FIG. 4, cavity 235 may be further configured to receive grounding cable 400 therein. Cavity may be configured such that grounding cable 400 may be provided adjacent to longitudinal member 105,410 following installation of grounding clamp 200. For example, lower surface 245 of cavity 235 may be spaced from notch 240 such that a center of longitudinal member 105,110 may be positioned substantially level with a center of grounding cable 400, as depicted in FIG. 2B. In one implementation, cavity 235 may be sized to accommodate different sizes of grounding cables 400.

In some embodiments, a lower surface of the body portion 205 may include a curved surface 280 for minimizing unwanted contact and potential damage that edges of ground clamp 200 may cause. In one exemplary implementation, bottom portion 210 may have a length ranging from 1.0 inches to 1.5 inches, and a thickness ranging from 0.40 inches to 0.75 inches.

As shown in FIG. 4, during installation of grounding clamp 200, longitudinal member 410 may enter cavity 235 and may be received into notch 240. In one embodiment, as shown in FIGS. 2A, 2B, 3, and 4, cavity 235 may include a curved lower surface 245. Curved lower surface 245 may facilitate smooth entry of longitudinal member 105/410 and grounding cable 400 into cavity 235. In one implementation consistent with aspects described herein, curved lower surface 245 may have a radius of curvature of between 0.40 inches and 0.6 inches.

In one implementation, each of finger-like members 225, 230 may include a first end 252 extending from and connected to the bottom portion 210, an intermediate portion 255 extending transversely to first end 252, and a second end 260 that is distal from first end 252. In one embodiment, second ends 260 of finger-like members 225, 230 may include outwardly extending flange portions 265 projecting from an inner portion thereof. As shown in FIGS. 2A and 2B, flange portions 265 may extend over and partially close cavity 235. Flange portions 265 may provide a substantially hook-like configuration to finger-like members 225, 230, thereby facilitating easy installation of ground clamp 200 to cable tray 100.

Figure 2C:
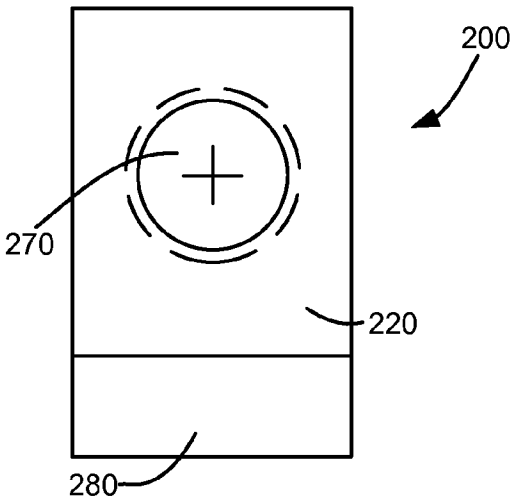
Figure 2F:
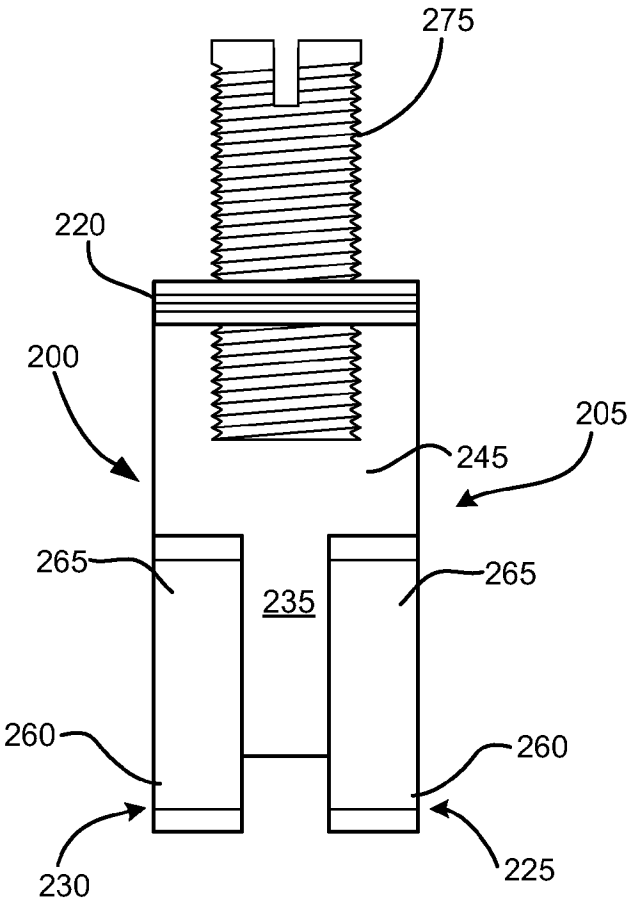
Figure 2E:
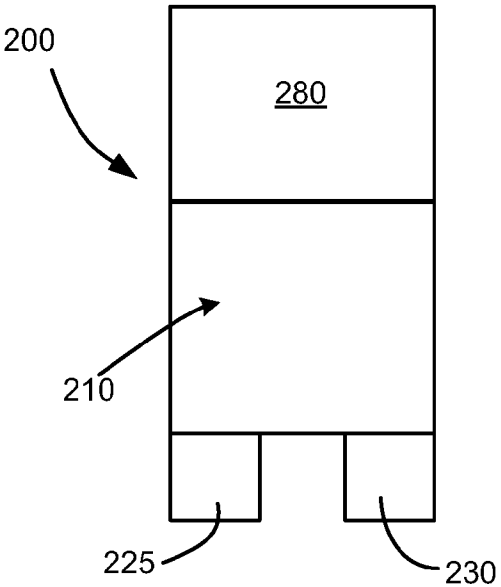

As shown in FIGS. 2A, 2C and 2D, outer end portion 220 may include a threaded hole 270 extending therethrough. In one implementation, threaded hole 270 may be positioned at a height substantially corresponding to a height of notch 240, such that hole 270 is aligned with longitudinal member 105/410 and grounding cable 400 upon installation of grounding clamp 200.

Consistent with embodiments described herein a threaded bolt 275 may be received in threaded hole 270. As shown in FIG. 4, securing of threaded bolt 275 within threaded hole 270, e.g., by turning bolt 275, causes bolt 275 to advance with hole 270. After suitable advancement, a leading end of bolt 275 may abut grounding cable 400 and cause grounding cable 400 to forcibly engage longitudinal member 105,410. Continued advancement of bolt 275 within hole 270 secures grounding cable 400 to longitudinal member 105/410. As described herein, bolt 275 may assist in holding grounding clamp 200 and grounding cable 400 in place, while also ensuring continuous electrical contact with grounding cable 400.

Although described above in terms of bolt 275, it should be understood that other fastening elements may be suitably used in a manner consistent with embodiments described herein. For example, a cotter-pin, clip, rivet, etc. may be used.

In further reference to FIGS. 3 and 4, it can be easily seen from these figures that, upon installation of grounding claim 200, body portion 205 extends outwardly from cable tray 100. The two finger-like members 225,230 engage selected transverse member 405 in between the finger-like members 225, 230. This configuration not only affords the installation of grounding cable away from the usable volume of the cable tray, but also affords protecting cable in the cable tray from unwanted contact, scratching and other damage that traditional clamps and other technologies might create.

By providing grounding clamp 200 for securing a grounding cable 400 to an exterior of cable tray 100, suitable grounding of cable tray 100 may be enabled in an easy-to-install manner without taking up volume in an interior of cable tray 100 or damaging the contents of cable tray 100. More specifically, by providing an open cavity 235 for receiving grounding cable 400, installers are easily able to install grounding cable 400 into grounding clamp 200. Moreover, increased efficient is realized by providing a single screw for securing both grounding clamp 200 and grounding cable 400 to cable tray 100. Furthermore, by providing a notched configuration, ground clamp 200 may be installed with one hand with the installer initially placing grounding clamp 200 onto cable tray 100, laying grounding cable 400 into cavity 235, and turning bolt 275 to secure grounding cable 400 and grounding clamp 200 to cable tray 100.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, various features have been mainly described above with respect to mesh-type cable tray 100. In other implementations, features described herein may be implemented in relation to other support structure technologies.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A grounding clamp for securing a grounding cable to a tray having a number of spaced apart longitudinal and transverse members, comprising:

a body portion having a bottom portion and inner and outer end portions projecting from the bottom portion;

wherein the inner end portion includes at least two finger-like members projecting from the bottom portion for engaging at least one transverse member between the finger-like members, wherein a portion of the body portion includes a cavity defined by the bottom portion, the inner end portion, and the outer end portion for receiving at least one longitudinal member therein, wherein the cavity further receives the grounding cable therein, and wherein the outer end portion includes a threaded opening therethrough; and a threaded bolt that is received in the threaded opening in the outer end portion for securing the grounding cable to the at least one longitudinal member.

2. The grounding clamp of claim 1, wherein the at least two finger-like members are spaced apart by a distance substantially similar to a size of the at least one transverse member.

3. The grounding clamp of claim 1, wherein each of the at least two finger-like members comprise:

a first end extending from, and connected to, the bottom portion;

an intermediate portion extending transversely to the bottom portion; and a second end distal from the first end, wherein the second end includes an outward projection that projects over, and partially closes, the cavity.

4. The grounding clamp of claim 3, wherein the intermediate portions of the at least two finger-like members comprise a notched portion for receiving the at least one longitudinal member therein.

5. The grounding clamp of claim 4, wherein the notched portion is sized substantially similar to a size of the at least one longitudinal member.

6. The grounding clamp of claim 1, wherein the cavity comprises a curved lower surface.

7. The grounding clamp of claim 6, wherein the curved lower surface has a radius of curvature of between 0.40 inches and 0.6 inches.

8. The grounding clamp of claim 1, wherein the body portion extends outwardly from the tray when the at least two finger-like projections engage the at least one transverse member therebetween.

9. The grounding clamp of claim 1, wherein the body portion and the threaded bolt comprises conductive materials.

10. The grounding clamp of claim 9, wherein the body portion comprises aluminum.

11. The grounding clamp of claim 1, wherein a mass of the body portion is sufficient to prevent damage to the grounding clamp in the event of a ground fault.

12. The grounding clamp of claim 1, wherein a lower surface of the body portion includes a curved surface.

13. The grounding clamp of claim 1, wherein the bottom portion has a length ranging from 1.0 inches to 1.5 inches, and wherein the body portion has a thickness ranging from 0.40 inches to 0.75 inches.

14. A device for securing a grounding cable to a mesh cable tray comprising a number of spaced apart longitudinal and transverse members, the device comprising:

a bolt; and a clamp body having two finger-like members for receiving a transverse member of the mesh cable tray therebetween, wherein the two finger-like members project from a bottom portion of the clamp body at a first location and wherein the clamp body includes an outside portion extending from the bottom portion at a second location distal from the first location, wherein the outside portion includes an opening therethrough for receiving the bolt, wherein a space between the finger-like members and the outside portion of the clamp body forms a cavity for a longitudinal member of the mesh cable tray therein when mounted to the mesh cable tray, wherein the cavity receives the grounding cable therein at a position proximate to the longitudinal member, and wherein, upon advancement of the bolt in the opening, an end of the bolt secures the grounding cable to the longitudinal member of the mesh cable tray.

15. The device of claim 14, wherein a space between the two finger-like members is substantially similar to a size of the transverse member of the mesh cable tray.

16. The device of claim 14, wherein the two finger-like members comprise a flanged portion outwardly projecting over a portion of the cavity.

17. The device of claim 14, wherein the two finger-like members comprise a notched portion for receiving the longitudinal member of the mesh cable tray.

18. The device of claim 14, wherein the cavity comprises a curved lower surface.

19. A system comprising:

a mesh type cable tray that includes a number of spaced apart transverse members and a number of spaced apart longitudinal members;

a securing element; and a grounding device having an inner portion to engage one of the transverse members, a bottom portion projecting from the inner portion, and an outer portion projecting from the bottom portion, wherein a space formed between the inner portion, the bottom portion, and the outer portion defines a cavity for receiving the one of the longitudinal members, wherein the cavity further receives a grounding cable therein, and wherein the securing the securing element to the outer portion affixes the grounding cable to the longitudinal member in the cavity.

20. The system of claim 18, wherein the securing element comprises a bolt and wherein the outer portion of the grounding device further comprises a threaded hole therethrough for receiving the bolt.

21. The system of claim 18, wherein the inner portion includes at least two finger-like members projecting from the bottom portion to engage one of the transverse members therebetween.

* * * * *